United States Patent [19]

Simon

[11] 4,277,969

[45] Jul. 14, 1981

[54] METHOD OF COLD FORMING TUBES WITH INTERIOR THICKER WALL SECTIONS

[76] Inventor: Joseph A. Simon, 237 Lothrop, Grosse Pointe Farms, Mich. 48236

[21] Appl. No.: 87,741

[22] Filed: Oct. 24, 1979

[51] Int. Cl.[3] ..... B21C 25/06

[52] U.S. Cl. ..... 72/266

[58] Field of Search ..... 72/266, 260, 265, 267, 72/273, 377

[56] References Cited

U.S. PATENT DOCUMENTS

| | | | |
|---|---|---|---|
| 3,837,205 | 9/1974 | Simon | 72/260 |
| 3,886,649 | 6/1975 | Simon | 228/112 |
| 3,948,073 | 4/1976 | Lovell | 72/256 |
| 4,166,373 | 9/1979 | Braun | 72/356 |

FOREIGN PATENT DOCUMENTS

| | | | |
|---|---|---|---|
| 662352 | 4/1963 | Canada | 72/260 |
| 129857 | 4/1902 | Fed. Rep. of Germany | 72/266 |
| 2100600 | 9/1971 | Fed. Rep. of Germany | 72/266 |

*Primary Examiner*—Roscoe V. Parker

*Attorney, Agent, or Firm*—Cullen, Sloman, Cantor, Grauer, Scott & Rutherford

[57] ABSTRACT

A method for cold forming metal tubes with inwardly thickened wall sections including positioning a short, tubular blank in a die having an extrusion die throat, and pushing the blank through the die throat with a punch. The punch is formed with a co-axial mandrel-like extension which fits within the blank and die throat. The extension is formed of co-axial sections of successively smaller diameter. Thus, as the punch pushes the end of the blank to move the blank through the die throat, a narrower diameter extension section fits within the die throat to extrude a thickened end portion. Thereafter, continued punch movement positions a wider mandrel forming extension section within the die throat to extrude a thin wall tube section. At a point where a wall thickened section is to be formed interiorly of the tube, the punch is removed and replaced by a different punch having a mandrel forming extension of different diameter than that mentioned above, wherein movement of the second punch results in the extrusion of a thickened tube section in the annular space between the extension section and the die throat, with continued punch movement thereafter positioning a further punch extension within the die throat for forming additional thin wall sections on the tube. The trailing end of the blank may then be provided with a thickened end section similar to the leading end of the blank by utilizing the initial punch in place of the second punch.

3 Claims, 12 Drawing Figures

METHOD OF COLD FORMING TUBES WITH INTERIOR THICKER WALL SECTIONS

BACKGROUND OF THE INVENTION

Metal truck axle tubes and similar types of steel tubular members have been manufactured in the past by either forging processes, machining processes or by cold forming processes such as disclosed in my prior U.S. Pat. No. 3,837,205 issued Sept. 24, 1974 or U.S. Pat. No. 3,886,649 issued June 3, 1975. These processes generally involve the production of a finished tube, having varying thickness wall sections, out of separate tube parts which are welded or otherwise secured together. Further, where the tube includes some thick wall sections along with some thin wall sections, manufacturing this kind of tube has been difficult and time consuming.

Thus, a cold forming process of the type disclosed in my above mentioned patents, is utilized in the present invention, with certain modifications and improvements, to thereby produce a one-piece, multiple thickness wall section tube which may be used as a truck axle tube or for other similar tube purposes. Particularly, the extrusion of such tubes, using a cold forming extrusion process lends itself to rapid production with relatively low cost and particularly to the opportunity to reduce weight by utilizing thin wall sections where possible while still producing the thicker wall sections needed for machining purposes, bearing supports, etc.

Thus, the invention herein relates to a cold forming or extrusion process for producing, in one die operation, a finished, elongated steel or the like metal tube which is essentially of thin wall cross-section, but is provided with thickened wall sections in areas desired.

SUMMARY OF INVENTION

The invention herein contemplates cold forming or extruding a short tubular blank into an elongated, thin wall finished tube of uniform O.D., but with thickened interior sections of smaller I.D. than the main body of the thin wall tube. The process involves positioning the blank within a die having a restricted opening die throat and pushing the blank through the die with a first and then a second, ram-like punch having extension portions, which like mandrels, extend through the blank and the die throat to extrude the blank material in the ring-like annular orifice formed between the extension and the throat. The first punch has an extension portion of an O.D. corresponding to the finished I.D. of the thin wall tube section and also an extension portion corresponding in O.D. to the I.D. of the leading and trailing end thickened portions of the punch. This punch extrudes the inwardly thickened lead end portion of the blank and then the thin wall section for a considerable length of the tube. Thereafter, the first punch is replaced by the second punch having mandrel-like extension portions which correspond to the I.D. of the thin wall tube section and also to the I.D. of interior ring-like enlargements formed within the tube. The second punch continues the extrusion of the partly extruded blank. Its smaller extension, when positioned within the die throat, results in the cold forming of the interiorly extending ring-like enlargement. Further movement of the punch results in again extruding a continuation of the thin wall section following the enlargement. Thereafter replacement of the second punch by the first punch permits the extrusion of the trailing end thickened portion. Simultaneously, by inserting a fresh blank within the die before reinserting the first punch, the leading end thickened portion is formed on the second blank.

The above cycle is repeated from blank to blank for continuous production, within a single die without removing the blank from the die, of a series of tubes, each having thickened opposite end sections and interior thickened portions. By merely changing the punch when and as required, the various thickened sections can be easily produced. Thus, in the conventional press equipment utilized for this purpose, it is a simple matter to mount a pair of punches upon an indexing type of ram so that the punches can be used one at a time and indexed from one punch to the next for rapid extrusion of the single blank within the single die.

As can be seen, an object of the invention herein is to provide a method which will rapidly produce a thin wall, elongated tube, such as on the order of two or three feet in length and of considerable diameter, such as an O.D. of 3–4 inches, out of steel, at room or cold temperatures, while permitting the selective location of wall thickening areas which may be needed.

Another object of this invention is to provide a relatively inexpensive way to rapidly cold form or extrude steel blanks into required size and wall thickness tubes of one-piece construction, to thereby eliminate prior manufacturing processes which involved the production of a number of separate pieces that were assembled together as by welding to produce a finished tube. In this manner, the tube formed by the process herein can be of a reduced weight. Further, the production involves considerably less handling and a reduction in the number of manufacturing steps to produce the tube. Thus, in addition to weight reduction, there can be reductions in overall manufacturing costs.

Where the tubes are used for truck or other vehicle axles, the weight reduction is especially important in view of the current trend to reduce the weights of vehicles in order to reduce fuel consumption. Thus, the method herein tends to produce a much lighter weight truck axle without sacrificing strength or quality, and in fact, producing a better quality and probably a better strength finished part, while at the same time reducing costs.

These and other objects and advantages of this invention will become apparent upon reading the following description, of which the attached drawings form a part.

DETAILED DESCRIPTION

Figure 12:
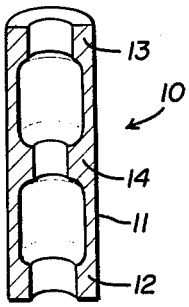
FIG. 12 is a cross-sectional perspective view of the finished tube.

FIG. 12 illustrates, in cross-section, a cold formed or extruded tube suitable for use as a truck axle. The tube 10, is formed out of a suitable steel material of required strength and specification. The tube comprises a thin wall section 11 which makes up the major portion of the tube, and opposite, inwardly thickened ends 12 and 13. That is, the wall thicknesses of the end portions 12 and 13 are greater than the wall thickness of the major portion of the tube.

In addition, within the tube one or more integral ring-like, annular enlargements 14 are formed. The enlargement 14, as illustrated in FIG. 12, provides a bore-like opening whose inner diameter is smaller than the I.D. of the end portions 12 and 13 and, of course, considerably smaller than the I.D. of the major portions of the tube.

Although the dimensions may vary widely, by way of example, the tube may be on the order of approximately two feet in length with an O.D. of about 3-½ inches and an I.D., at the thin wall sections of about 3 inches so that the wall thickness is about ¼ inch. The ring-like enlargement may have a wall thickness of about ½ inch. Obviously, the thickness of the walls and the dimensions depend upon the purpose for which the tube is to be used and therefore varies accordingly. With this arrangement of interior enlargements, the tube may be used for a number of purposes, in addition to the truck axle purpose.

When a truck axle is formed from the tube, the interior walls of the portions 12, 13 and 14, may be suitably machined or otherwise processed to produce precise dimensions and interior finishes, as required, as for example to receive bearings or other parts. The invention of this application is concerned with the method for producing the tube itself with the interior enlargements or wall thicknesses which are greater than the thin wall thickness of the body of the tube.

The tube is formed within a die 15 which is mounted upon a suitable press (not shown). A conventional press of sufficient tonnage is utilized for the purposes of cold forming or cold extruding the steel or other metal tube. The press may be of the horizontal axis type or the vertical type, with the die accordingly mounted upon the bed of the press in the conventional manner.

Figure 1:
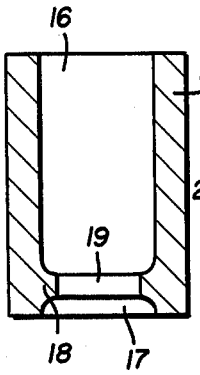
FIG. 1 is a cross-sectional, elevational view of the die.

The die 15 interior wall is generally cylindrical in shape, as illustrated in FIG. 1, and includes an inlet end 16, an outlet end 17 and an intermediate annular shoulder-like restriction 18 which forms the die throat 19.

Figure 2:
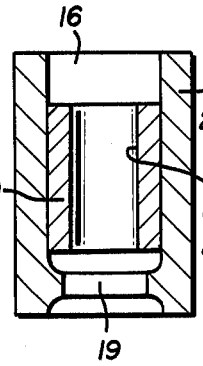
FIG. 2 is a cross-sectional view showing the blank inserted within the die.

A tubular blank 20, of a pre-selected size and thickness, is normally inserted within the die, as illustrated in FIG. 2. The inner wall 21 of the blank is provided with a smaller I.D. than the diameter of the die throat 19.

Figure 3:
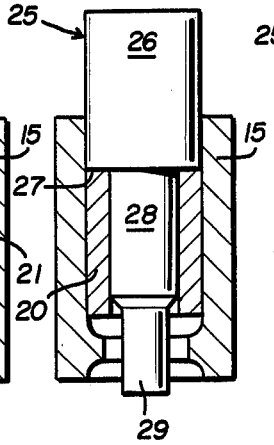
FIG. 3–FIG. 10 respectively show successive steps in the method herein.

As shown in FIG. 3, once the blank is inserted within the die, a punch 25 is inserted within the die. The punch is connected to the ram or press mechanism of the force supplying press so that it may move in a direction axially of the die. The punch includes a ram end portion 26 whose inner surface forms an annular ram-like shoulder 27 which engages and presses against the end of the blank 20.

The punch also includes an extension, which like a mandrel, extends within the interior of the blank and the die throat. The extension is formed of a first extension part 28 whose O.D. corresponds to the I.D. of the blank. That is, the O.D. of the extension 28 is sized to closely fit within the blank and to provide the finished I.D. of the thin wall section of the tube.

The extension includes a second, smaller diameter extension section 29 whose O.D. corresponds to the I.D. of the thickened end portions 12 and 13 of the tube.

Figure 4:
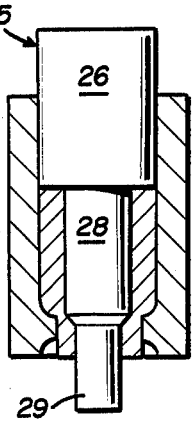
Figure 5:
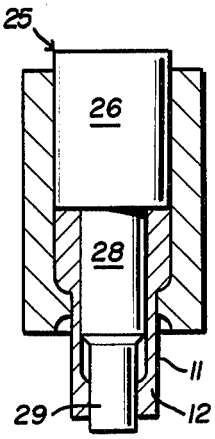

FIG. 3 shows the punch inserted within the blank. FIG. 4 shows the punch moving towards the die throat and thereby extruding the leading edge of the blank through the die throat. The extrusion of material occurs through the annular space between the die throat shoulder 18 and the second, smaller diameter extension 29. Thus, the leading end of the blank is formed with the thickened end section 12, as shown in FIG. 5.

The movement of the metal through the die, around the mandrel-like extension sections, occur at a faster rate than the movement of the punch in the axial direction. Thus, the punch is considerably shorter in length than the resultant tube.

As the punch moves axially, the first extension section 28 enters into the die throat space to reduce the cross-sectional thickness of the space between the die throat and the mandrel-like extension. This results in the extrusion of the thin wall section of the tube, as illustrated in FIG. 5.

Figure 6:
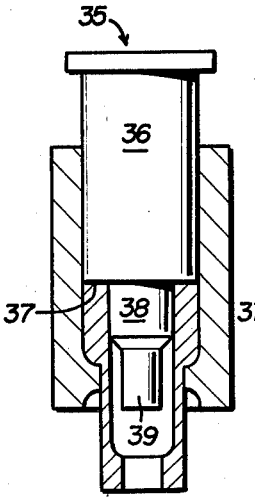

After the thin wall section of the tube is extruded to the point where an inward enlargement 14 is desired, the punch 25 is stopped. It is then withdrawn from the die, leaving the partially extruded blank still within the die. At this point, a second punch 35 is inserted into the die. FIG. 6 schematically illustrates the second punch 35, fitted into the die with its ram portion 36 filling the die opening and its annular ram-like shoulder 37 engaging the trailing end of the blank.

The second die 35 is provided with a mandrel-like extension whose first extension portion 38 corresponds in O.D. to extension section 28 of the punch 25. However, its second or smaller diameter extension portion 39 is of smaller diameter than the extension 29 of the first punch 25, so that it is appropriately sized to form the ring-like enlargement 14.

Figure 7:
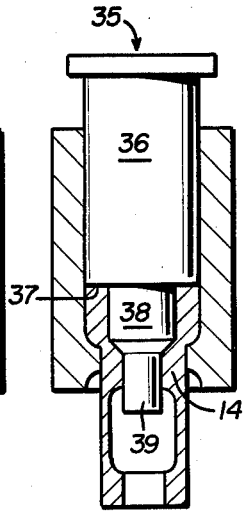

FIG. 6 illustrates the punch 35 before its movement in an axial direction, with its smaller extension 39 positioned within the die throat. Movement of the die 35, as shown in FIG. 7, results in the cold flow or extrusion of the metal from the unextruded portion of the blank into the space between the die throat and the smaller extension 39 to thereby form the thickened ring-like enlarged section 14.

Figure 8:
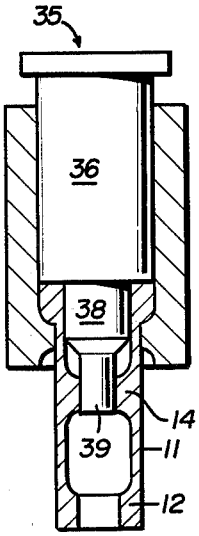

Continued movement of the punch 35, as shown in FIG. 8, results in its first extension 38 entering into the die throat, thereby discontinuing the formation of the enlargement 14 and now extruding the continuation of the thin wall section of the tube.

Figure 9:
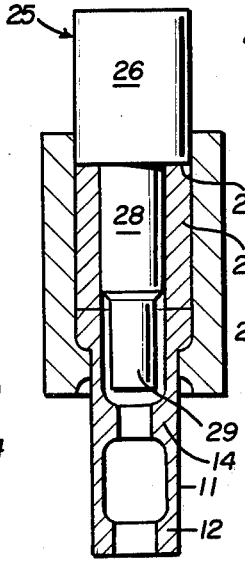
Figure 10:
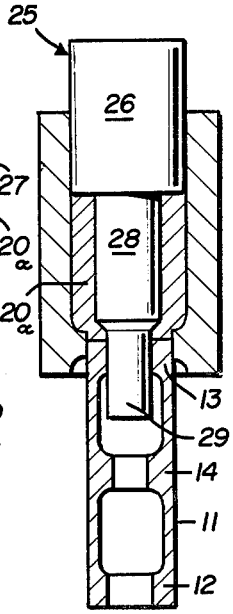
Figure 11:
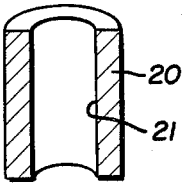
FIG. 11 is a perspective, cross-sectional illustration of the starting blank.

When the thin wall extrusion is completed, that is when the predetermined length has been reached, the punch 35 is retracted from the die and the first punch 25 is reinserted back into the die, as shown in FIG. 9. However, before reinserting the punch 25, a new, second blank **20*a* is inserted into the die. Thus, the annular ram-like shoulder 27 engages the trailing end of the new blank 20*a*, which in turn has its leading edge abutted against and pushing the trailing end of the partially formed blank 20 below it. FIG. 9** shows this arrangement.

Thereafter, the punch 25 is again moved in the direction of the die throat, causing its smaller extension 29 to enter into the die throat to extrude the trailing end thickened portion 13. At the same time, the leading end thickened portion of the second blank is also extruded.

When the trailing end thickening portion 13 is completed, the extruded tube drops from the die and the process continues with the second blank. The cycle then continues in the same manner as described above, adding successive blanks so that each blank is successively formed as the cycle is repeated.

Additional inward enlargements 14 can be formed within the tube during the extrusion process by repeating the steps of removing the initial punch and replacing it with another punch at the appropriate places within the tube. Thus, one or more ring-like enlargements can be formed within the tube, integral with, and appropriately positioned within the tube.

As can be seen, the process herein is relatively inexpensive, rapid in operation and results in the production of thin wall tubes with integral thickened sections for support of additional elements or for strength purposes or the like. Also, because of the cold forming extrusion method used, the metallurgical structure of the finished metal is particularly desirable.

The cold forming herein is conducted at room temperature ordinarily. That is, the blank, which may first be phosphate coated for lubrication purposes, is inserted within the die at room temperature. Thereafter, movement of the punch and extrusion of the metal may result in a temperature increase in the blank as it is extruded due to the extrusion itself, that is the movement of the molecular structure of the metal. It has been found that in this type of process, the temperature may rise to the range of roughly 300° F. during the processing of a single part. However, this temperature is considerably below the transition temperature of the metal so that it has no ill affect upon the metal. For some purposes, it may be desirable to heat the blank to a low degree, but below the transition temperature of the metal. Preferably the metal blank is at room temperature at the start and no heat is applied to it other than the heat developed during the process itself.

Having fully described an operative embodiment of this invention, I now claim:

1. A process for extruding a thin wall metal tube having an integral inwardly extending, annular, ring-like thickened portion, comprising the steps of:

positioning a relatively short, tubular blank within an open ended, tubular die having an inlet end through which the blank is inserted and an opposite extrusion end formed by an annular, inwardly extending shoulder forming a die extrusion throat, through which the blank is extruded;

inserting a first punch into the die inlet end, with the punch having a portion closely fitted within the die and having an annular ram shoulder engaged against the free, trailing end of the blank, and with the punch also having a punch extension closely fitted within the blank interior wall and extending through the blank to the die throat, with the punch ram shoulder, punch extension, blank and die throat all being arranged co-axially with each other;

moving the first punch towards the die throat while its extension portion is positioned within the die throat to thereby extrude the leading part of the blank through the space between the die throat and first extension to form a wall tube portion of predetermined length;

removing the first punch from the die and inserting a second punch within the die in its place, with the second punch having a first extension portion corresponding in diameter to the extension portion of the first punch, and a second extension portion whose O.D. is smaller than the O.D. of the extension portion of the first punch;

moving the second punch axially towards the die throat to initially position its second extension within the die throat to extrude a ring-like inwardly thickened formation within the tube, and thereafter, as the punch movement continues, positioning its first extension portion within the die throat to again extrude the tube wall until a predetermined tube length is reached.

2. A process for extruding a thin wall metal tube as defined in claim 1, and including after the last mentioned step, adding the steps of:

removing the second punch from the die, and inserting a second tubular blank within the die in end to end contact with the partially extruded blank trailing end;

reinserting the first punch in the die with its ram shoulder engaging the trailing end of the second blank and with its extension closely fitted within the second blank;

again moving the first punch in the direction of the die throat with its extension within the die throat, so that the second blank pushes the remainder of the first, partially extruded blank through the annular space between the second punch extension and the die throat to form the remainder of the tube, and also, simultaneously extrude the leading end portion of the second blank.

3. A process of extruding a thin wall metal tube having integral inwardly extending, annular, ring-like thickened portions, comprising the steps of:

positioning a relatively short, tubular blank within an open ended, tubular die having an inlet end through which the blank is inserted and an opposite extrusion end formed by an annular, inwardly extending shoulder forming a die extrusion throat, through which the blank is extruded;

inserting a first punch into the die inlet end, with the punch having a portion closely fitted within the die and having an annular ram shoulder engaged against the free, trailing end of the blank, and with the punch having a punch extension extending through the blank to the die throat, and with the punch extension having a first punch extension portion closely fitted within the interior wall of the blank, and a second extension portion of a smaller diameter than the first extension portion extended through the blank and die throat, with the punch ram shoulder, punch extensions, blank and die throat all being arranged co-axially with each other;

moving the first punch towards the die throat while its second extension portion is positioned within the die throat to thereby extrude the leading part of the blank through the space between the die throat and first extension to form a thickened leading end wall tube portion;

continuing axial movement of the first punch to position its first extension portion within the die throat to thereby extrude a pre-determined length of thin wall section;

removing the first punch from the die and inserting a second punch within the die in its place, with the second punch having a first extension portion corresponding in diameter to the first extension portion of the first punch, and a second extension portion whose O.D. is smaller than the O.D. of the first extension portion of the first punch;

moving the second punch axially towards the die throat to initially position its second extension within the die throat to extrude a ring-like inwardly thickened formation within the tube, and thereafter, as the punch movement continues, positioning its first extension portion within the die throat to again extrude the thin wall tube until a pre-determined tube length is reached;

then removing the second punch from the die, and inserting a second tubular blank within the die in end to end contact with the partially extruded blank trailing end;

reinserting the first punch in the die with its ram shoulder engaging the trailing end of the second blank and with its first extension closely fitted within the second blank;

again moving the punch in the direction of the die throat while aligning the second extension within the die throat, so that the second blank pushes the remainder of the first, partially extruded blank through the annular space between the second punch extension and the die throat to form an inwardly thickened end portion on the trailing end of the first blank, and also, simultaneously extruding an inwardly thickened end portion on the leading end of the second blank.

* * * * *